US010749294B2

(12) United States Patent
Fong

(10) Patent No.: US 10,749,294 B2
(45) Date of Patent: Aug. 18, 2020

(54) ANGLE LOADBREAK BUSHING

(71) Applicant: ABB Schweiz AG, Baden (CH)

(72) Inventor: Robert Fong, Bethlehem, PA (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/155,535

(22) Filed: Oct. 9, 2018

(65) Prior Publication Data

US 2020/0112123 A1 Apr. 9, 2020

(51) Int. Cl.
*H01R 13/53* (2006.01)

(52) U.S. Cl.
CPC ..... *H01R 13/53* (2013.01)

(58) Field of Classification Search
CPC .. H01R 13/6485; H01R 13/53; H01R 13/637; Y10S 439/921; H05K 9/0067
USPC ..... 439/181, 183–187, 921
See application file for complete search history.

(56) References Cited

U.S. PATENT DOCUMENTS 3,513,425 A * 5/1970 Arndt ..... H01R 13/53 337/201
4,203,641 A * 5/1980 Siebens ..... H01R 13/53 439/339
5,041,004 A * 8/1991 Waldorf ..... F16B 31/02 439/306
6,042,407 A * 3/2000 Scull ..... H01R 13/53 439/181
6,168,447 B1 * 1/2001 Stepniak ..... H01R 13/53 439/187
8,641,434 B2 * 2/2014 Siebens ..... H01R 13/53 439/181
9,396,888 B1 * 7/2016 Yeckley ..... H01H 9/52
2007/0151953 A1 * 7/2007 Meinherz ..... H02B 5/06 218/155

* cited by examiner

*Primary Examiner* — Hien D Vu
(74) *Attorney, Agent, or Firm* — Taft Stettinius & Hollister LLP; J. Bruce Schelkopf

(57) ABSTRACT

A loadbreak bushing that includes a loadbreak trunk and at least one loadbreak leg. Opposing ends of the loadbreak trunk can include a first connection interface and a second connection interface, respectively, the first connection interface being configured to be matingly received in a bushing well. Each loadbreak leg, which can include a contact assembly having at least a female contact, can extend along a central leg axis from the loadbreak trunk to a third, or leg, connection interface, the central leg axis being slanted or diagonal relative to a central trunk axis of the loadbreak trunk. The third connection interface can be configured to be coupled to an elbow connector that is coupled to a power cable, among other electrical connectors, while the second connection interface can be configured to be coupled to a grounding elbow connector, among other electrical connectors and accessories.

20 Claims, 10 Drawing Sheets

ANGLE LOADBREAK BUSHING

BACKGROUND

Embodiments of the present application generally relate to separable electrical connectors. More particularly, but not exclusively, embodiments of the present application relate to angled loadbreak bushings.

Loadbreak bushings, including, for example, loadbreak bushings used in conjunction with transformers, among other electrical equipment, generally are electrically coupled to a bushing well of the transformer. Additionally, loadbreak bushings are also configured for electrical coupling to an electrical connector, such as, for example, a loadbreak connector, that is coupled to a power cable. In at least some situations, the coupling, or decoupling of a physical connection between the loadbreak bushing and the loadbreak connector and/or bushing well can facilitate, or otherwise contribute to, the occurrence of relatively dangerous flashover.

For example, when a loadbreak bushing is received into a cavity of a loadbreak connector that is operably connected to a power cable, the loadbreak bushing can displace a volume of air that was in at least a portion of the cavity that is now being occupied by the loadbreak bushing. The loadbreak connector and/or loadbreak bushing can also be configured to facilitate the formation of a seal, such as, for example, a dust or moisture seal, between the loadbreak connector and the loadbreak bushing. Thus, in the event the loadbreak connector is to be disassembled from the loadbreak insert, the initial displacement of the loadbreak connector relative to the loadbreak insert can result in an increase in air volume in the cavity. However, while the volume of air in the cavity may increase, the seal between the loadbreak connector and loadbreak insert may limit the flow of air into the cavity, thereby decreasing the pressure within the cavity, which can thereby decrease the dielectric strength of the air in the cavity, and in more specifically, decrease the dielectric strength of the air along an interface between the bushing insert and the power cable elbow to ground. In at least certain situations, such a decrease in the dielectric strength of the air can at least contribute to the occurrence of flashover.

Further, traditionally, loadbreak inserts have a generally linear configuration. More specifically, traditionally, loadbreak inserts are configured such that the portion of the loadbreak insert that is coupled to the bushing well is generally linearly aligned with the portion of the loadbreak insert that is coupled to the loadbreak connector. As a consequence, often during installation and disassembly involving such loadbreak inserts and loadbreak connectors, a worker is required to stand in direct line with the transformer load point and/or directly in front or above the transformer application. However, such direct, in-line positioning of the worker can be associated with safety concerns, including, for example, concerns for the safety of the worker relating to occurrence of flashover. Additionally, such linear alignment of the loadbreak insert can result in the worker engaging the loadbreak insert or mating electrical components at positions that are ergonomically deficient.

BRIEF SUMMARY

An aspect of an embodiment of the present application is a loadbreak bushing configured to be electrically coupled to a bushing well. The loadbreak bushing can include a loadbreak trunk that extends along a central trunk axis from a first connection interface to a second connection interface of the loadbreak bushing, and at least a portion of the first connection interface can be structured to be matingly received within the bushing well. The loadbreak bushing can also include a loadbreak leg that extends along a central leg axis from the loadbreak leg to a third connection interface of the loadbreak bushing, the central leg axis being non-parallel and non-perpendicular to the central trunk axis. Additionally, the loadbreak bushing can include an inner sleeve that extends into both the loadbreak trunk and the loadbreak leg, the inner sleeve having a first passageway that extends along the central trunk axis between an opening in the first connection interface and an opening in the second connection interface. The inner sleeve can further include a second passageway that extends along the central leg axis in least a portion of the loadbreak leg, the second passageway being in fluid communication with an opening in the third connection interface. Further, the loadbreak bushing can include a contact assembly that is housed within the second passageway of the inner sleeve and which can include a female contact.

Another aspect of an embodiment of the present application is a loadbreak bushing that is configured to be coupled to a bushing well. The loadbreak bushing can include an outer bushing jacket that has a central jacket trunk and at least one jacket leg. The central jacket trunk can extend between a first end and a second end of the central jacket trunk along a central trunk axis, and each of the at least one jacket leg can extend from the central jacket trunk along a central leg axis that is both non-parallel and non-perpendicular to the central trunk axis. Additionally, the loadbreak bushing can include an insulating jacket, and a portion of the insulating jacket can extend along the central trunk axis between at least a first connection interface and a second connection interface of the insulating jacket. The first connection interface can be positioned outside of the first end of the central jacket trunk and configured to be matingly received within the bushing well. The second connection interface can be positioned outside of the second end of the central jacket trunk. Further, for each of the at least one jacket leg, the insulating jacket can further include an insulating leg that extends along the central leg axis and through an end of the at least one jacket leg. The portion of the insulating leg that extends through the end of the at least one jacket leg can comprise at least another connection interface. Further, the loadbreak bushing can include an inner sleeve that can be housed within the insulating jacket. The inner sleeve can be electrically conductive and include a first passageway that extends along the central trunk axis between at least the first and second connection interfaces. The inner sleeve can also include a second passageway in the insulating leg of each of the at least one jacket leg. Additionally, the loadbreak bushing can include a contact assembly that can be housed in the second passageway, and which can include a female contact.

Additionally, another aspect of an embodiment of the subject application is a loadbreak bushing that is configured to be electrically coupled to a bushing well. The loadbreak bushing can include a loadbreak trunk that extends along a central trunk axis from a first connection interface to a second connection interface of the loadbreak bushing, and at least a portion of the first connection interface can be structured to be matingly received within the bushing well. The loadbreak bushing can also include a plurality of loadbreak legs, and each of the plurality of loadbreak legs can extend along a central leg axis to a leg connection interface of the loadbreak bushing. Further, the central leg axis for each of the plurality of loadbreak legs can be non-parallel and non-perpendicular to both the central trunk axis and the central leg axis of other loadbreak legs of the plurality of loadbreak legs. The loadbreak bushing can further include an inner sleeve that can be housed in both the loadbreak trunk and the plurality of loadbreak legs. The inner sleeve can be electrically conductive and have a first passageway that extends along the central trunk axis between an opening in the first connection interface and an opening in the second connection interface. The inner sleeve can further comprise, for each of the plurality of loadbreak legs, a second passageway that extends along the central leg axis in a portion of each of the loadbreak leg, the second passageway being in fluid communication with an opening in the leg connection interface. Additionally, the loadbreak bushing can also include a contact assembly that can be housed within the second passageway of the inner sleeve, and which can include a female contact and an arc quenching material.

BRIEF DESCRIPTION OF THE DRAWINGS

The description herein makes reference to the accompanying figures wherein like reference numerals refer to like parts throughout the several views.

Figure 1:
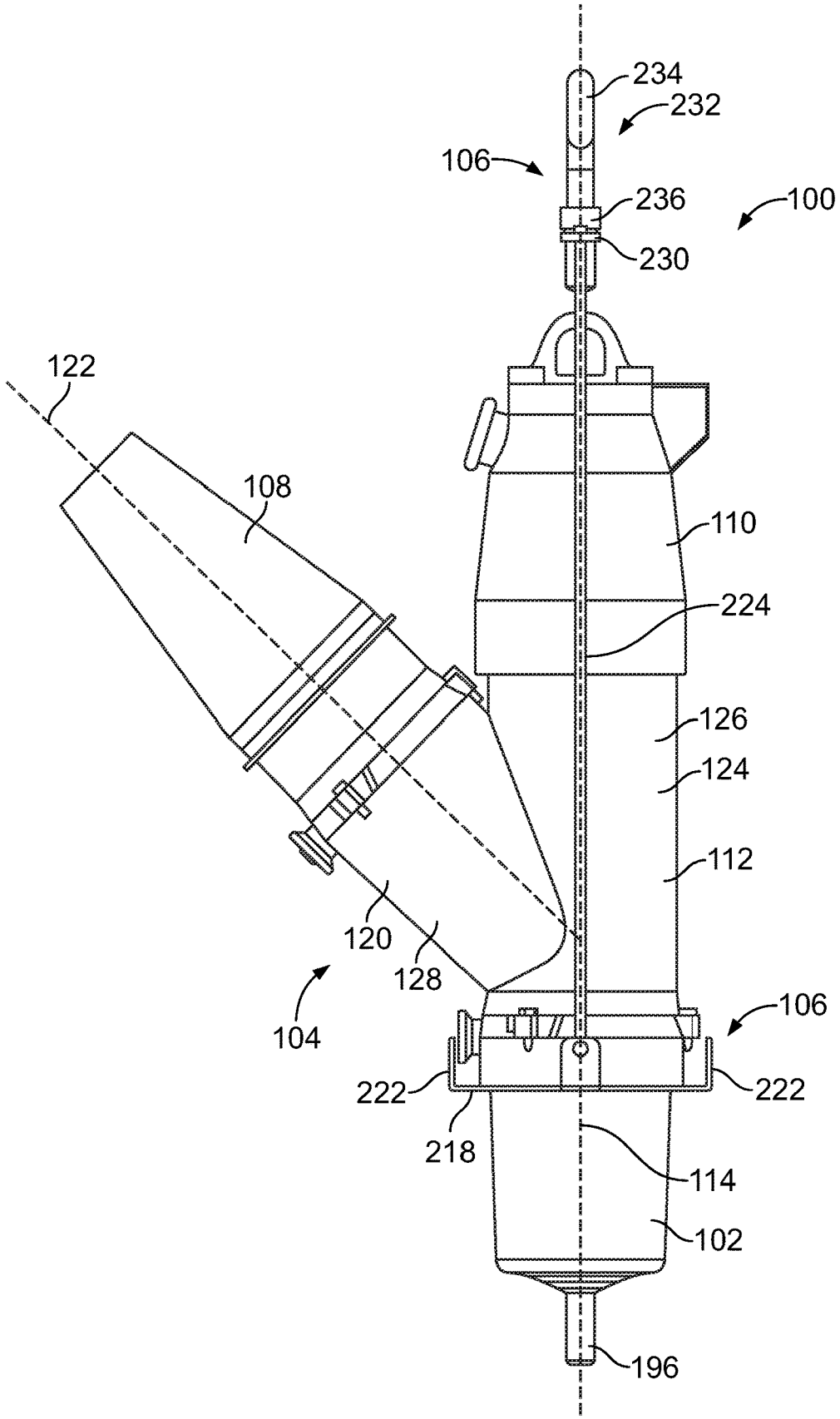
FIG. 1 illustrate a front side view of an exemplary loadbreak bushing assembly coupled to a bushing well according to an illustrated embodiment of the subject application.

The foregoing summary, as well as the following detailed description of certain embodiments of the present application, will be better understood when read in conjunction with the appended drawings. For the purpose of illustrating the application, there is shown in the drawings, certain embodiments. It should be understood, however, that the present application is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a front side view of an exemplary loadbreak bushing assembly 100 according to an illustrated embodiment of the subject application coupled to a bushing well 102. As shown, the loadbreak bushing assembly 100 can include a loadbreak bushing 104, a bushing bail assembly 106, and one or more bushing caps 108, 110. According to the illustrated embodiment, and as discussed below, the loadbreak bushing 104 has a loadbreak trunk 112 that generally extends along a central trunk axis 114 between first and second ends 116, 118 (FIGS. 2 and 3A) of the loadbreak trunk 112. Additionally, the exemplary loadbreak bushing 104 also includes at least one loadbreak leg 120 that outwardly extends from the loadbreak trunk 112 along a central leg axis 122.

The angle at which the central leg axis 122 extends relative to at least the central trunk axis 114 can vary. Moreover, according to certain embodiments, the central leg axis 122 can outwardly extend along an angle relative to the central trunk axis 114 such that the central leg axis 122 is non-parallel and non-perpendicular to the central trunk axis 114. For example, according to certain embodiments, the central leg axis 122 can outwardly extend at an angle (as indicated by "$\alpha$" in FIG. 3A) relative to the central trunk axis 114 that is greater than 0 degrees and less than 90 degrees, and more preferably is around 45 degrees from the central trunk axis 114.

The loadbreak bushing 104 can include an electrically conductive outer bushing jacket 124 that can be formed or molded from a variety of different types of materials, including, for example, a conductive (or semi-conductive) peroxide-cured synthetic rubber, commonly referred to as EPDM (ethylene-propylene-dienemonomer), among other materials. According to the illustrated embodiment, the outer bushing jacket 124 includes a generally central jacket trunk or body 126 and one or more jacket legs 128. According to the illustrated embodiment, the central jacket trunk 126 generally axially extends along the central trunk axis 114 between a first end 130 and a second end 132 of the central jacket trunk 126.

The jacket leg 128 of the embodiment of the bushing jacket 124 depicted in FIG. 1 can outwardly extend from a portion of the central jacket trunk 126 at a location(s) that is generally between the first and second ends 130, 132 of the central jacket trunk 126. For example, as shown by at least FIG. 1, the jacket leg 128 can outwardly extend from the central jacket trunk 126 at a location this is at, or generally in the vicinity of, a middle location or section of the central jacket trunk 126 between the first and second ends 130, 132 of the central jacket trunk 126, among other locations along the central jacket trunk 126. However, the jacket leg 128 can extend from a variety of other locations including, for example, from a location that is positioned between the first end 130 and a midsection of the central jacket trunk 126, or from a location that is positioned between the midsection and the second end 132 of the central jacket trunk 126. Thus, the jacket leg 128 can extend along the central leg axis 122 such that the jacket leg 128 outwardly extends at a diagonal or slated direction away from the central jacket trunk 126.

Figures 3A, 3B:
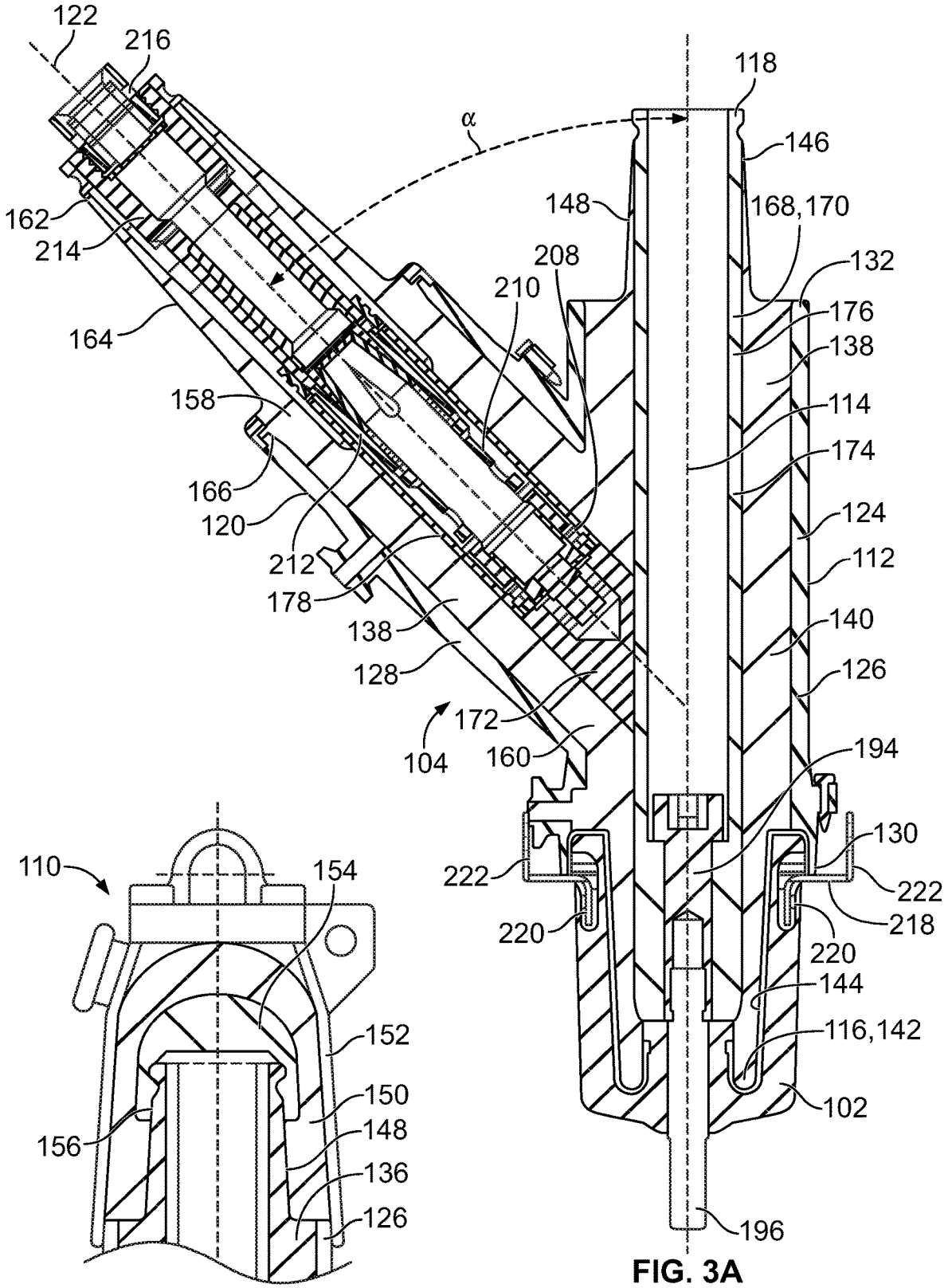
FIG. 3A illustrates an exemplary cross sectional front side view of the loadbreak bushing shown in FIG. 2 coupled to the bushing well.
FIG. 3B illustrates a cross sectional view of an insulated cap in mating engagement with a second connection interface of a loadbreak bushing.

As shown in FIG. 3A, the central jacket trunk 126 and jacket leg 128 can also each generally define at least first and second portions 134*a*, 134*b*, respectively, of an interior cavity 136 of the bushing jacket 124. The first portion 134*a* of the interior cavity 136 can generally be defined by the central jacket trunk 126 and extend along the central trunk axis 114. The second portion 134*b* of the interior cavity 136 of the bushing jacket 124 can be generally defined by the jacket leg 128 and extend generally along the central leg axis 122. Additionally, the first and second portions 134*a*, 134*b* of the interior cavity 136 can be in fluid communication with each other.

Within the interior cavity 136 of the outer bushing jacket 124, as well as extending therefrom, is an insulating jacket 138. The insulating jacket 138 can be formed or molded from a variety of types of insulating materials, including, but not limited to, rubber, synthetic rubber, plastic, and/or EPDM, among other materials. As shown in FIG. 3A, the insulating jacket 138 can include an insulating trunk 140, a portion of which extends through the jacket trunk 126, and also generally extends along the central trunk axis 114 of the loadbreak bushing 104. Further, a first end 142 of the insulating trunk 140 extends beyond the first end 130 of the central jacket trunk 126 to form at least a portion of a first connection interface 144 of the loadbreak bushing 104.

The first connection interface 144 can have a shape and size that is configured to be matingly received within the bushing well 102, as shown, for example, by at least FIG. 3A. Moreover, as shown in at least FIG. 3A, according to certain embodiments, the portion of the insulating jacket 138 that extends beyond the first end 130 of the central jacket trunk 126 to the first end 142 of the insulating trunk 140 that forms the first connection interface 144 can have an inwardly tapered configuration such that the portion of the insulating trunk 140 that is generally adjacent to the first end 130 of the central jacket trunk 126 has a size, such as, for example, an outer diameter, that is larger than the corresponding size of the insulating trunk 140 at the first end 142 of the insulating trunk 140. The particular configuration of at least the outer size and/or shape of the first connection interface 144, such as, for example, the degree and length of taper of the outer surface of the first connection interface 144 can be based on a variety of different considerations, including, but not limited to, the configuration of the mating interior portion of the bushing well 102 into which the first connection interface 144 will be inserted and/or one or more associated industry, manufacturer, and/or customer standards, including, but not limited to, one or more standards as set forth by the American National Standards Institute (ANSI).

Similarly, a second end 146 of the insulating trunk 140 extends beyond the second end 132 of the central jacket trunk 126 to form a second connection interface 148 of the loadbreak bushing 104. The second connection interface 148 can have a variety of shapes and sizes, including, for example, a shape and size that is configured to be matingly received within an insulated cap 110, such as, for example, the insulated cap 110 shown in FIG. 3B, and/or a grounding elbow connector, among other electrical connectors and components. For example, as shown in at least FIG. 2, according to certain embodiments, the portion of the insulating jacket 138 that extends beyond the second end 132 of the central jacket trunk 126 to the second end 146 of the insulating trunk 140 that forms the second connection interface 148 can have an inwardly tapered configuration such that the portion of the insulating trunk 140 that is generally adjacent to the second end 132 of the central jacket trunk 126 has a size, such as, for example, outer diameter, that is larger than the corresponding size of the insulating trunk 140 at the second end 146 of the insulating trunk 140. Additionally, similar to the first connection interface 144, the axial length of the second connection interface 148 in a direction generally along, or parallel to, the central trunk axis 114 can be sized to facilitate mating engagement with the mating electrical component, such as, for example, the insulated cap 110 and/or grounding elbow connector, respectively. Again, as is also similar to the first connection interface 144, the configuration of at least the outer size and/or shape of the second connection interface 148, such as, for example, the degree and length of taper of the outer surface of the second connection interface 148, can be based on a variety of different considerations, including, but not limited to, the configuration of the mating interior portion of the electrical connector and/or accessory into which the second connection interface 148 will be inserted, and/or be based on one or more associated industry, manufacturer, and/or customer standards.

As shown in FIG. 3B, according to certain embodiments, the insulated cap 110 can include an insulative inner housing 150 that is positioned within an outer conductive or semi-conductive shield 152, and which has a tapered inner surface that is configured to matingly engage at least a portion of the tapered surface of the second connection interface 148. Additionally, the insulated cap 110 can include a conductive or semi-conductive insert 154 that surrounds at least a portion of the second end 146 of the insulating trunk 138. Moreover, the insert 154 can be configured to securely engage a recess 156 in the second end 146 of the insulating trunk 138 or of the inner sleeve 174 in a manner that can assist in retaining the insulated cap 110 in relatively secure engagement with the second connection interface 148. A similar recess 156 can also be located at or around the third connection interface 164.

Figure 2:
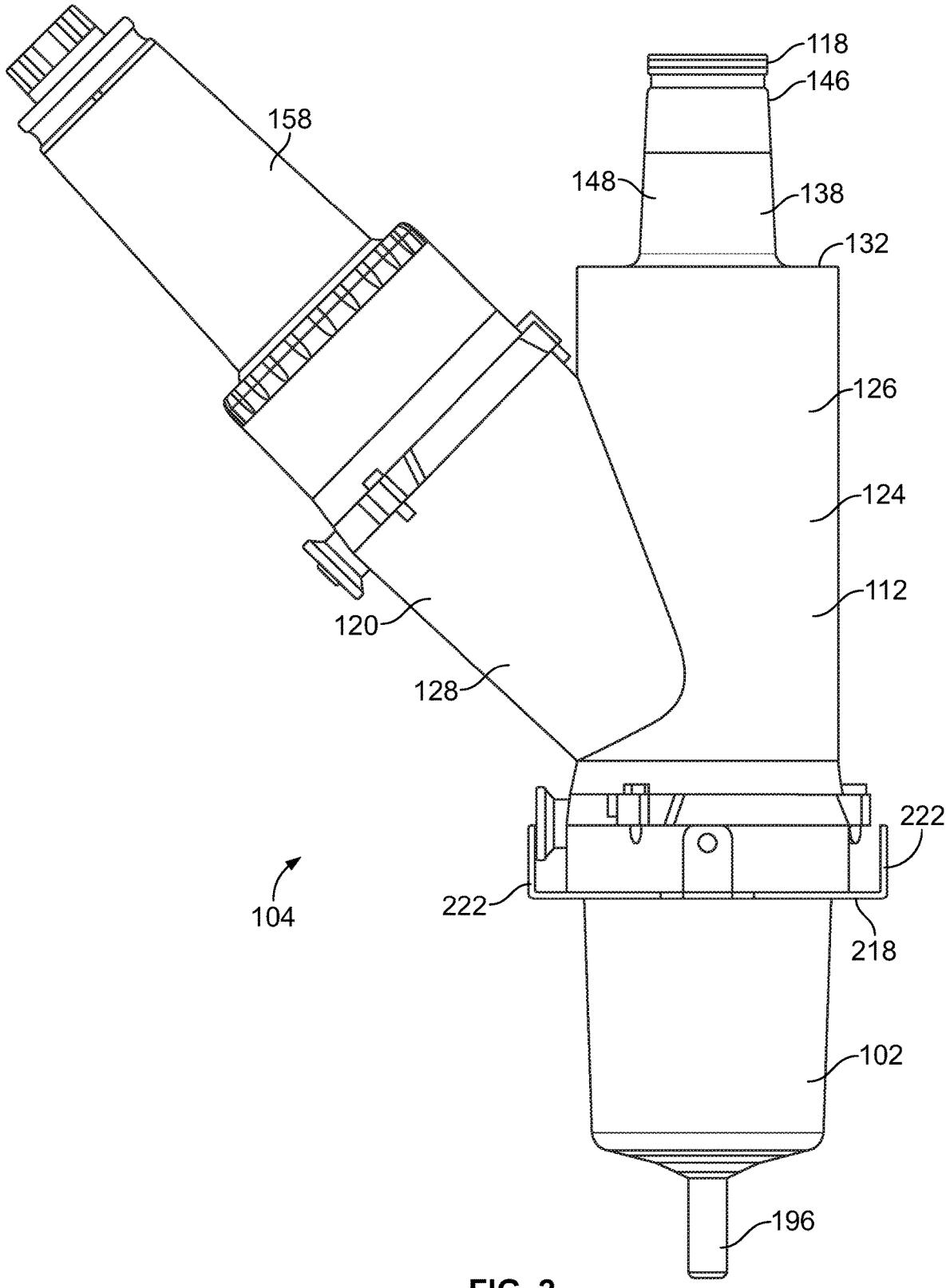
FIG. 2 illustrates a front side view of a loadbreak bushing of the loadbreak bushing assembly shown in FIG. 1 coupled to the bushing well.

As shown in FIGS. 2 and 3A, the insulating jacket 138 also includes an insulating leg 158 that extends between first and second ends 160, 162 of the insulating leg 158. Further, the insulating leg 158 diagonally extends from the insulating trunk 140 generally along the central leg axis 122 such that, similar to the jacket leg 128, the insulating leg 158 is slanted relative to at least the central trunk axis 114. Additionally, a portion of the insulating leg 158 extends out from the jacket leg 128 to form at least a portion of a third connection interface 164 of the loadbreak bushing 104.

The third connection interface 164 can have a shape and size configured to accommodate at least a portion of the third connection interface 164 being received in a cavity of a mating electrical component and/or accessory, such as, for example, a bushing cap 108 and/or a loadbreak connector, including, but not limited to an elbow connector that is coupled to a power cable, among other electrical connectors. For example, as shown by at least FIGS. 2-6, the portion of the insulating leg 158 extending from an end 166 of the jacket leg 128 can have an inwardly tapered configuration such that the insulating leg 158 that is generally adjacent to the end 166 of the jacket leg 128 has a size, such as, for example, an outer diameter, that is larger than the corresponding size of the insulating leg 158 at the second end 162 of the insulating leg 158.

According to certain embodiments, and similar to the first and second connection interfaces 144, 148, the angle and length of taper, among other sizes, of the third connection interface 164 can be based on a selected standard, such as, for example, an industry, customer, and/or manufacturer standard, such that the third connection interface 164 is sized to matingly engage an associated component and/or accessory. Additionally, while according to certain embodiments each of the first, second, and third connection interfaces 144, 148, 164 can be configured to comply with the same standard, according to other embodiments, at least one of the first, second, and third connection interfaces 144, 148, 164, can comply with a standard that is different than a standard that is used for the configuration of another one of the first, second, and third connection interfaces 144, 148, 164. Furthermore, according to certain embodiments, at least one of the first, second, and third connection interfaces 144, 148, 164 can have a configured that is, or is not, similar to the configuration of at least one of another one of the first, second, and third connection interfaces 144, 148, 164. Additionally, while the illustrated embodiment depicts each of the first, second, and third connection interfaces 144, 148, 164 being male connection interfaces, according to other embodiments, one or more of the first, second, and third connection interfaces 144, 148, 164 could be female connection interfaces.

As shown by FIG. 3A, the insulating jacket 138 can include an inner cavity 168 having a first portion 170 that extends between both the first and second ends 142, 146 of the insulating trunk 140 generally along the central trunk axis 114, and a second portion 172 that extends through the insulating leg 158 along the central leg axis 122. Further, according to the illustrated embodiment, the first portion 170 of the inner cavity 168 is in fluid communication with the second portion 172 of the inner cavity 168.

Figure 7:
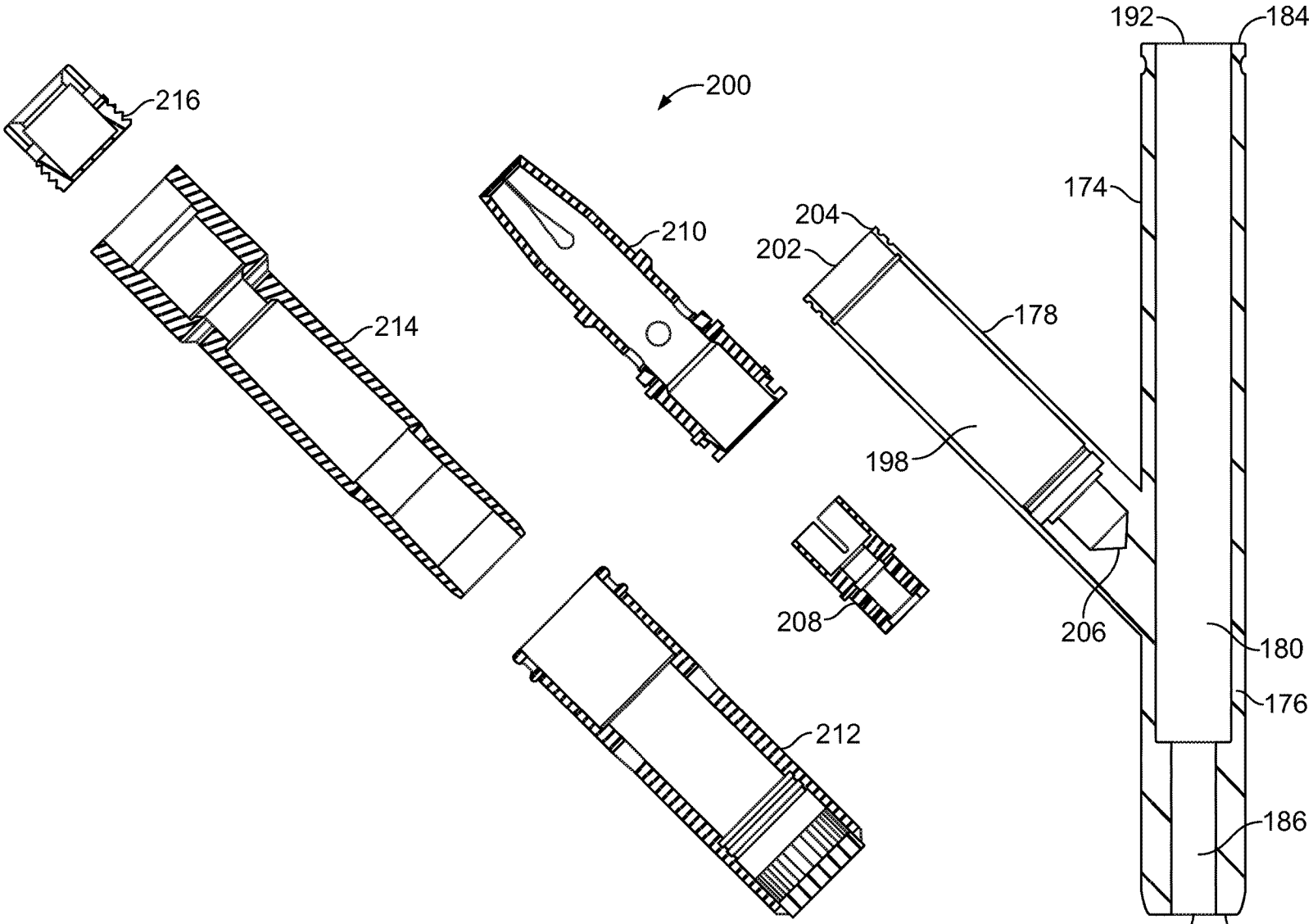
FIG. 7 illustrates a cross sectional exploded view of a contact assembly of the loadbreak bushing shown in FIG. 2.

Referencing FIGS. 3A and 7, the loadbreak bushing 104 can further include an inner sleeve 174 that is positioned within at least a portion of the inner cavity 168 of the insulating jacket 138. The inner sleeve 174 is constructed from a variety of electrically conductive materials, including, but not limited to aluminum, aluminum alloys, copper, and copper alloys, among other electrically conductive materials. Alternatively, according to other embodiments, the inner sleeve 174 can be formed or molded from an electrically conductive or electrically non-conductive material and be coated, at least partially, with an electrically conductive material. According to certain embodiments, the inner sleeve 174 can include a sleeve trunk 176 and a sleeve leg 178. The sleeve trunk 176 is positioned in the first portion 170 of the inner cavity 168 of the insulating jacket 138 and generally extends along the central trunk axis 114, while the sleeve leg 178 is positioned in the second portion 172 of the inner cavity 168 of the insulating jacket 138 and generally extends along the central leg axis 122.

According to the illustrated embodiment, the sleeve trunk 176 includes a first passageway 180 that extends generally from a first end 182 of the sleeve trunk 176 to a second end 184 of the sleeve trunk 176. The first passageway 180 can include a first portion 186 that extends to a first opening 188 at the first end 182 of the sleeve trunk 176, and a second portion 190 extends to a second opening 192 at the second end 184 of the sleeve trunk 176. As seen in at least FIGS. 3A and 7, the second portion 190 can have a size, such as, for example, an inner diameter, that is larger than a corresponding size of the first portion 186. Moreover, the first portion 186 is sized to receive placement of a portion of a bushing bolt 194 that threadingly engages a well stud 196 of the bushing well 102. For example, an aperture can extend from a first end 182 of the bushing bolt 194 that includes an internal thread that is configured to, when the bushing bolt 194 is operably positioned in the first portion 186, threadingly engage an external thread of the well stud 196. The differences in size, such as, for example, diameters, between the first and second portions 186, 190 of the first passageway 180 can facilitate the formation of a shoulder within the first passageway 180 at a distance from the second end 184 of the sleeve trunk 176 that can accommodate the shoulder being abutted by a bottom surface of a head of the bushing bolt 194 at least when the bushing bolt 194 is threadingly secured to the well stud 196. Thus, the head of the bushing bolt 194 can have a size, such as, for example, outer diameter, which is larger than a corresponding size, such as inner diameter, of the first portion 186. The second portion 190 can be sized to accommodate the placement of the bushing bolt 194 into the first passageway 180, as well as for receipt of a tool that can operably engage the head of the bushing bolt 194, such as, for example, a hexagonal shaped feature of the head, so that the tool can rotate the bushing bolt 194 to tighten the engagement of the head of the bushing bolt 194 against the shoulder as the bushing bolt 194 is threadingly displaced along the well stud 196.

The sleeve leg 178 can include a second passageway 198 that can house at least a portion of a contact assembly 200. As shown in at least FIGS. 3A and 7, the second passageway 198 can extend generally along the central leg axis 122 from an opening 202 in the second passageway 198 at an end 204 of the sleeve leg 178 to a closed end 206 of the second passageway 198. Thus, according to certain embodiments, the second passageway 198 may not be in fluid communication with the first passageway 180. Alternatively, according to other embodiments, the second passageway 198 can extend from the opening 202 of the second passageway 198 to the first passageway 180 such that the first and second passageways 180, 198 are in fluid communication with each other.

As shown in at least FIG. 7, the contact assembly 200 can include a piston 208, a female contact 210, a non-conductive sleeve 212, and an arc quenching sleeve 214, and can also be coupled to an extension tube 216. The female contact 210 can be electrically coupled to the sleeve leg 178 and the piston 208. Further, according to certain embodiments, the piston 208 and/or female contact 210 can be moveable within the inner sleeve 174, and can each be constructed from an electrically conductive material. Alternatively, according to other embodiments, the piston 208 can be directly or indirectly coupled or fastened to the inner sleeve 174, such as, for example, via a threaded engagement between the piston 208 and the inner sleeve 174 and/or via a mechanical fastener, such as, for example, a bolt that threadingly engages at least the inner sleeve 174.

The non-conductive sleeve 212 can be constructed from a variety of different materials, including, for example, plastic or rubber, among other materials. Further, according to certain embodiments, at least a portion of the arc quenching sleeve 214 and/or the female contact 210 can extend into at least a portion of the non-conductive sleeve 212. According to the illustrated embodiment, a portion of the non-conductive sleeve 212 outwardly extends out from the second end 162 of the insulating leg 158 and inwardly within the insulating leg 158 to around a midsection of the insulating leg 158 such that at least an upper portion of the female contact 210 is within at least a portion of the non-conductive sleeve 212. Similarly, a portion of the arc quenching sleeve 214, which can be constructed from an arc quenching material, can, at one end, outwardly extend from both the non-conductive sleeve 212 and the second end 162 of the insulating leg 158, while another portion inwardly extends into the insulating leg 158 to a depth at which the arc quenching sleeve 214 extends out from the non-conductive sleeve 212 such that the arc quenching sleeve 214 extends further around of the female contact 210 than the non-conductive sleeve 212.

The illustrated bushing bail assembly 106 can be configured to provide a positive hold down force between the loadbreak bushing 104 and the bushing well 102. As shown, the bushing bail assembly 106 can include a base 218 that is coupled to the bushing well 102. For example, as shown by FIG. 3A, one or more arms 220 positioned along an inner portion of the base 218 can extend into an adjacent inner region of a sidewall of the bushing well 102. Moreover, according to certain embodiments, a portion of a sidewall of the bushing well 102 can be molded around the arms 220 of the base 218. Further, two or more flanges 222 can upwardly extend from an outer periphery of the base 218 such that the flanges 222 are generally orthogonal to the base 218. Each of the flanges 222 can be configured to be coupled to a leg 224 of the bushing bail assembly 106. For example, according to certain embodiments, each flange 222 can include one or more holes that can receive a first end 226 of a leg 224. Further, as shown by at least FIG. 4, the first end 226 of the legs 224 can be curved or otherwise have a hook shaped configuration that can assist in retaining the first end 226 of the legs 224 in, and/or in engagement with, the hole of the corresponding flange 222.

Figure 4:
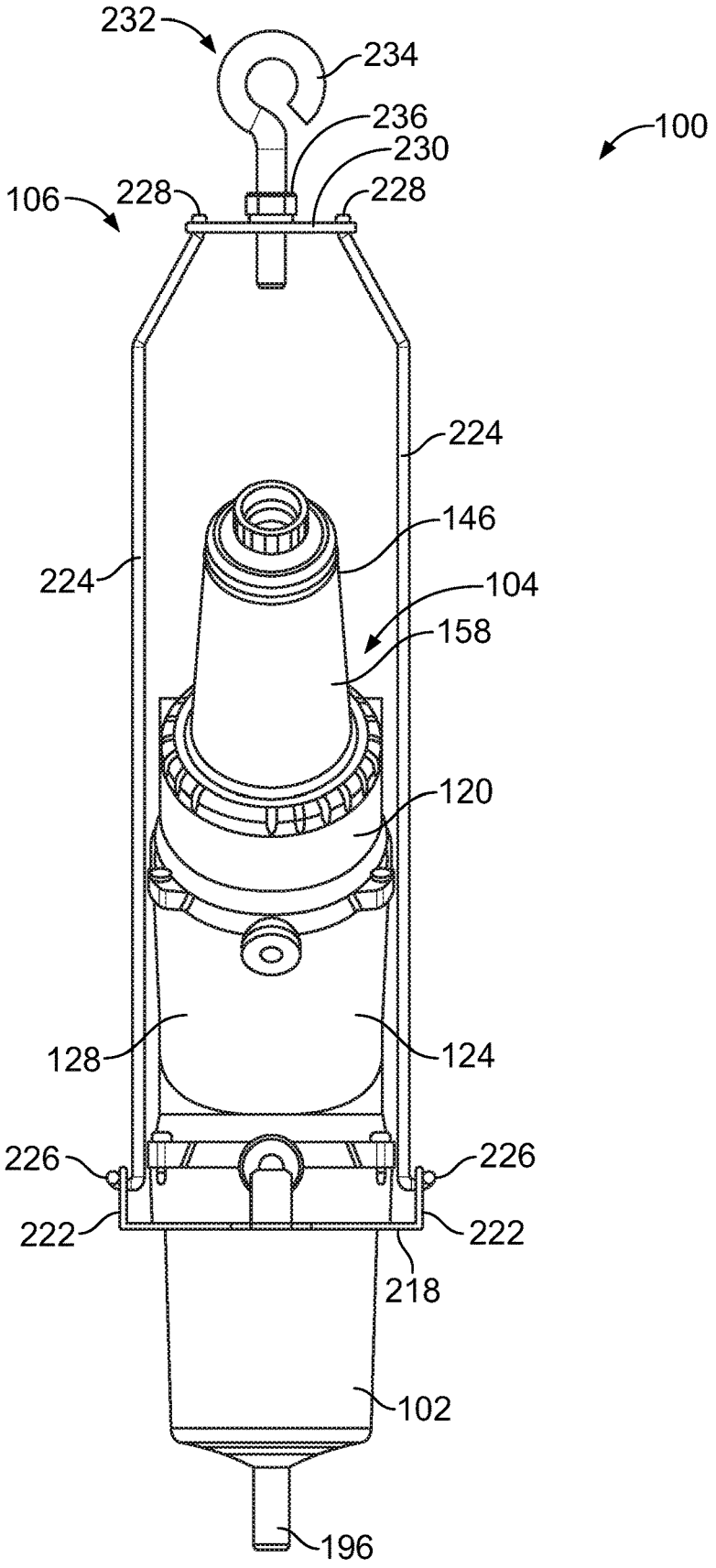
FIG. 4 illustrates a side view of the loadbreak bushing assembly shown in FIG. 1 coupled to the bushing well but without a bushing cap on a third connection interface of the loadbreak bushing.
Figure 5:
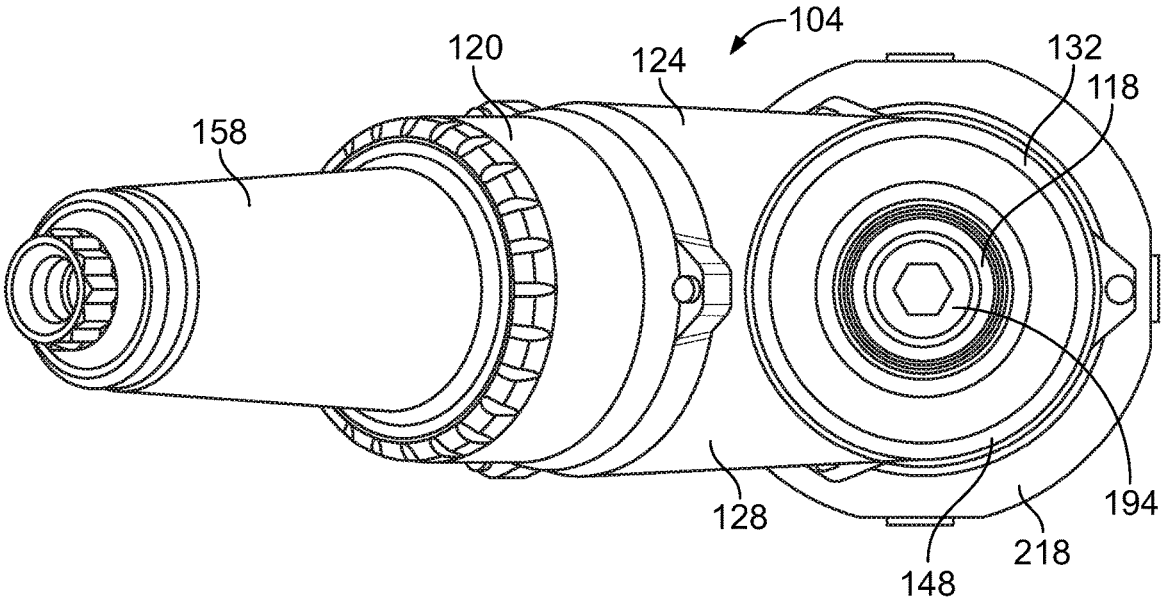
FIGS. 5 and 6 illustrate top and bottom side views, respectively, of the loadbreak bushing shown in FIG. 2.
Figure 6:
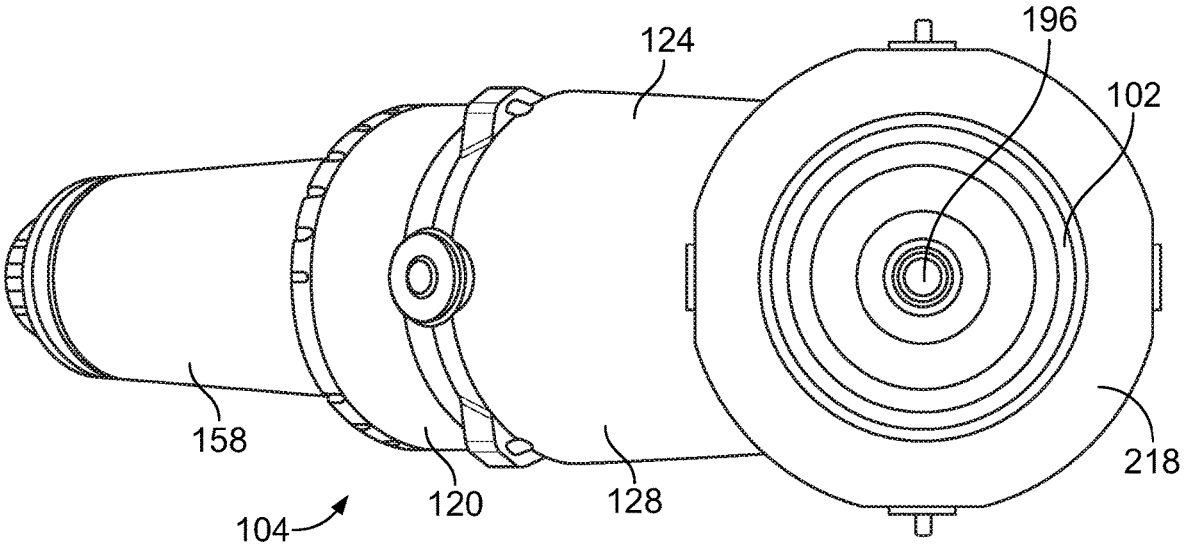

The legs 224 can each have a length between the first end 226 and a second end 228 of the leg 224 such that, when the first end 226 is positioned within the hole of the flange 222 and the loadbreak bushing 104 is operably engaged with the bushing well 102, the second end 228 of the leg 224 is positioned above or over the second connection interface 148, as shown, for example, by at least FIG. 4. The second end 228 of the legs 224 can be coupled to a bracket 230 of the bushing bail assembly 106. For example, the second end 228 of the legs 224 can be each receive in a corresponding hole in the bracket 230. Further, the second end 228 of the legs 224 can be configured, such as, for example, have a curvature or other shape, that can facilitate retention of the second end 228 of the legs 224 within the corresponding hole in the bracket 230.

The bushing bail assembly 106 can also include an adjustment assembly 232 that can be operably coupled to the bracket 230. The adjustment assembly 232 can be configured to adjust the positive hold down force provided by the bushing bail assembly 106 between the loadbreak bushing 104 and the bushing well 102. According to the illustrated embodiment, the adjustment assembly 232 includes a driver 234 and a retainer 236, the retainer 236 being configured to retain the adjustable linear position of the driver 234 relative to at least the bracket 230. The linear position of the driver 234 can be adjusted such that the driver 234 can at least be moved into, or away from, a pressing relationship with component that is coupled to the second connection interface 148 in an manner that can control the downward force exerted onto at least the loadbreak bushing assembly 100. According to certain embodiments, the driver 234 can be in a threaded engagement with the retainer 236.

Figure 8:
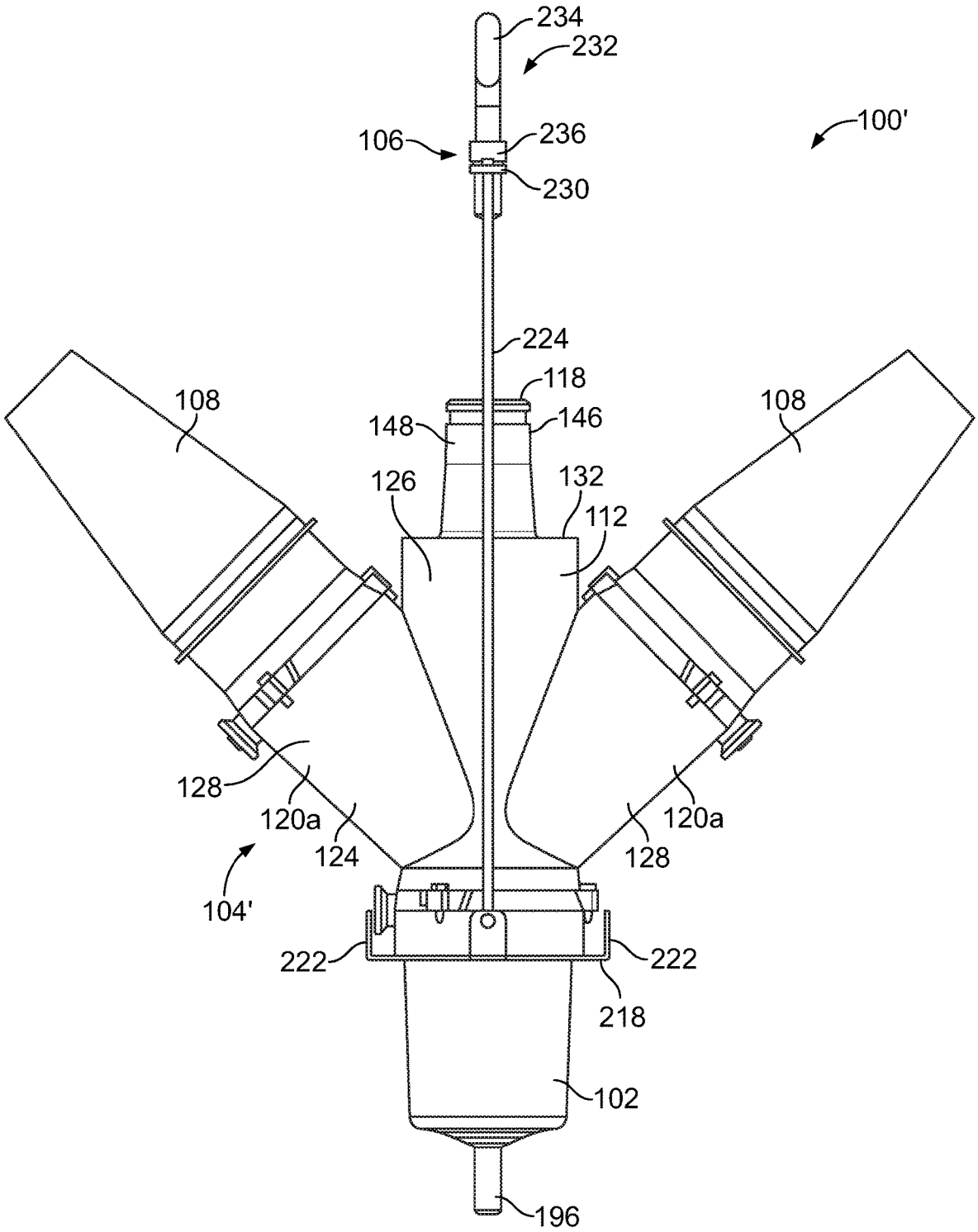
FIG. 8 illustrates a front side view of an exemplary loadbreak bushing assembly according to an illustrated embodiment of the subject application coupled to a bushing well.
Figure 9:
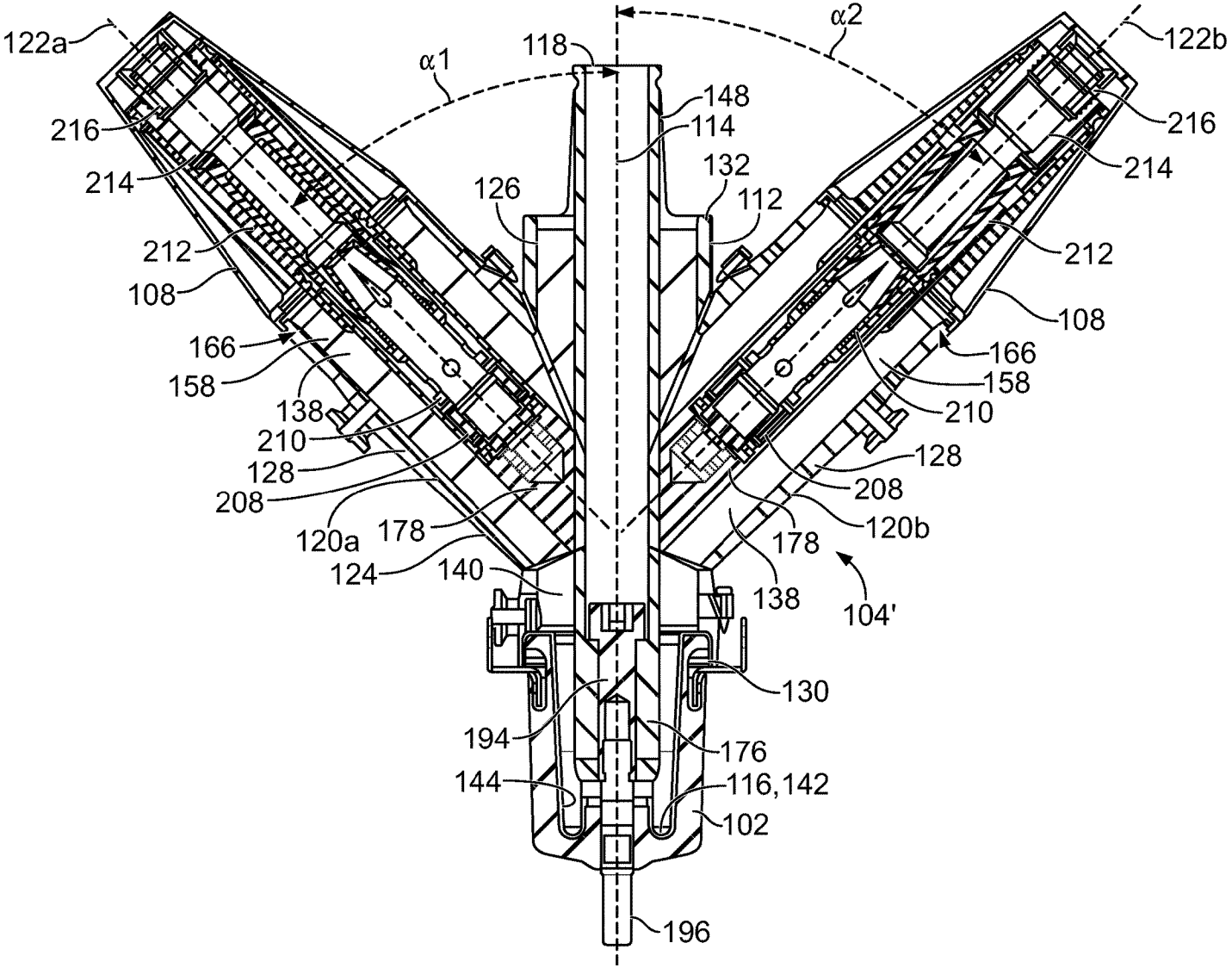
FIG. 9 illustrates a cross sectional view of an exemplary loadbreak bushing of the loadbreak bushing assembly shown in FIG. 8.
Figure 10:
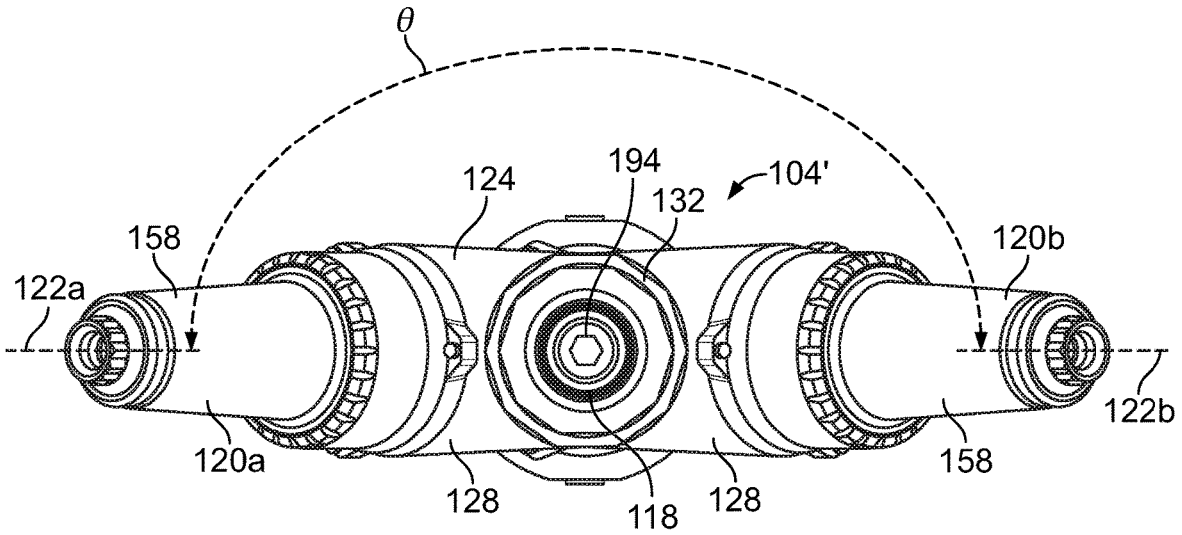
FIGS. 10 and 11 illustrate a top side view and a bottom side view, respectively, of the loadbreak bushing shown in FIG. 8.
Figure 11:
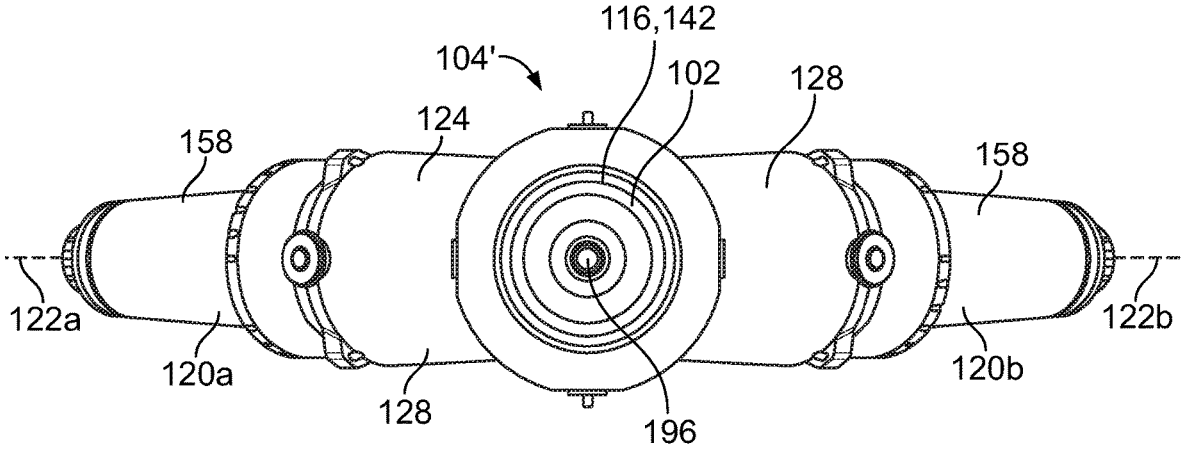

While the embodiment depicted in FIGS. 1-7 discloses a loadbreak bushing assembly 100 having a single loadbreak leg 120, the loadbreak bushing 104 can have a plurality of loadbreak legs. For example, FIG. 8 illustrates a front side view of a loadbreak bushing assembly 100' according to an illustrated embodiment of the subject application having a first loadbreak leg 120*a* and a second loadbreak leg 120*b*. However, according to other embodiments, the loadbreak bushing 104' can be configured to have even more loadbreak legs 120, 120*a*, 120*b*, 120*c* such as, for example, but not limited to, three (FIG. 12) or four loadbreak legs. Additionally, the outer jacket leg 128, insulating leg 158, sleeve leg 178, and the female contact assembly 200 discussed above with respect to the exemplary loadbreak bushing 104 depicted in FIGS. 1-7 can be generally similar for each of the loadbreak legs 120*a*, 120*b* for loadbreak bushings 100' that have a plurality of loadbreak legs 120*a*, 120*b*.

Further, according to certain embodiments, each loadbreak leg 120*a*, 120*b* can outwardly extend from the central jacket trunk 126 at a similar height or axial position along the loadbreak trunk 112, namely generally in the vicinity of a midsection between the first and second ends 116, 118 of the loadbreak trunk 112, among other locations along the loadbreak trunk 112. However, according to other embodiments, one or more of the plurality of loadbreak leg 120*a*, 120*b* can extend from an axial position between the first and second ends 116, 118 of the loadbreak trunk 112 that is different than the axial position along the loadbreak trunk 112 at which at least one other loadbreak legs 120*a*, 120*b* can outwardly extend from the loadbreak trunk 112. For example, referencing the first and second loadbreak legs 120*a*, 120*b* shown in FIGS. 8-11, one of the first loadbreak leg 120*a* and the second loadbreak leg 120*b* can extend from an axial position along the loadbreak trunk 112 between the first end 116 and a midsection of the loadbreak trunk 112, and the other of the first loadbreak leg 120*a* and the second loadbreak leg 120*b* can extend from the loadbreak trunk at an axial position between the midsection and the second end 118 of the loadbreak trunk 112.

Figure 12:
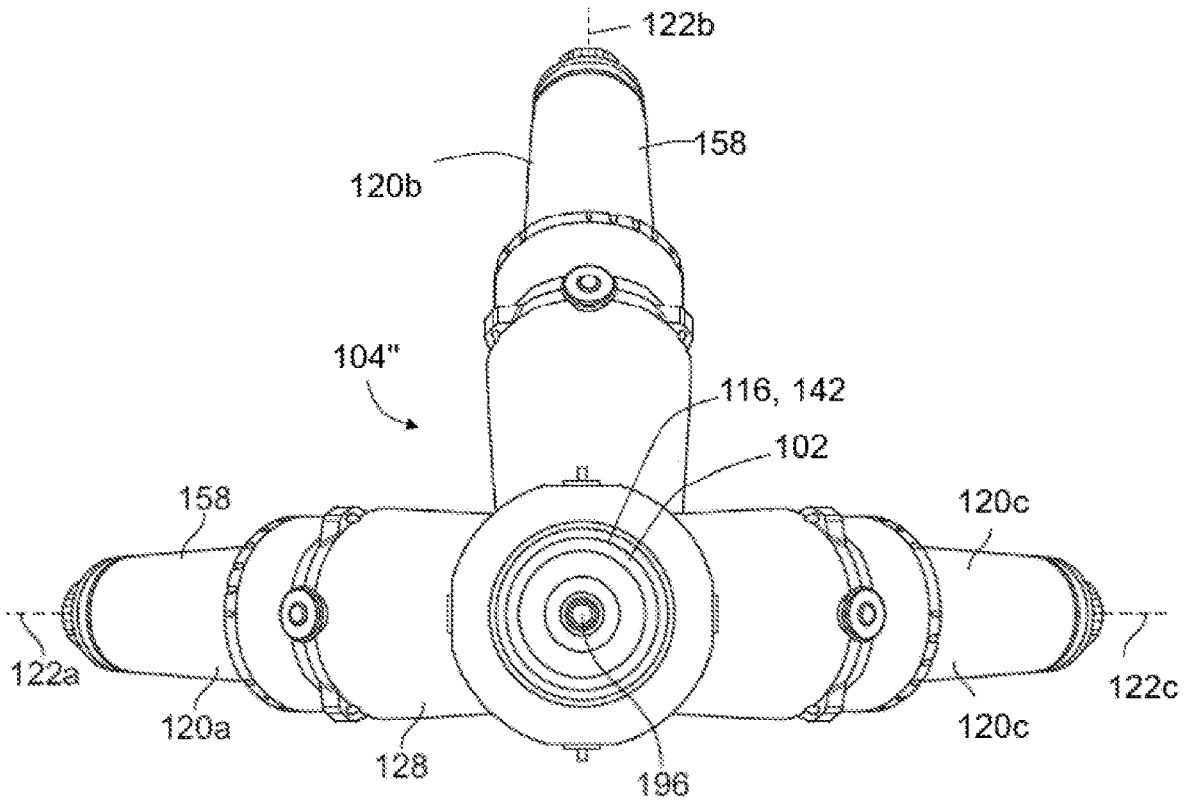
FIG. 12 illustrates a top side view of a loadbreak bushing having three jacket legs.

Additionally, while the first and second loadbreak legs 120*a*, 120*b* are depicted in at least FIGS. 8-11 as being generally positioned on opposing sides of the loadbreak bushing 104' such that the first and second loadbreak legs 120*a*, 120*b* are radially positioned about the loadbreak trunk 112 such that the first and second loadbreak legs 120*a*, 120*b* are around 180 degrees apart from each other (as indicated by "θ" in FIG. 10), the loadbreak legs 120*a*, 120*b* can be positioned at a variety of angular positions relative to each other. For example, according to certain embodiments, the loadbreak bushing 104' can include first and second loadbreak legs 120*a*, 120*b* that are positioned such that the first loadbreak leg 120*a* is separated from the second loadbreak leg 120*b* by an angle θ that is between around 80 degrees to around 280 degrees, and more particularly around 90 degrees to 270 degrees, among other angles. Further, the angle of separation between generally adjacent loadbreak legs 120*a*, 120*b* may, or may not, be the same for each pair of adjacent loadbreak legs 120*a*, 120*b*. For example, as shown in FIG. 12, according to certain embodiments, the loadbreak bushing 104" can include three loadbreak legs, the first loadbreak leg 120*a* being separated from the second loadbreak leg 120*b* by an angle θ that is around 80 degrees to around 100 degrees, and more particularly around 90 degrees, and the second loadbreak leg 120*b* is separated from a third loadbreak leg 120*c* having a central leg axis

122*c*, by an angle that is generally in the range of around 80 degrees to around 100 degrees, but which is either less than, or greater than, 90 degrees.

Additionally, similar to the central axis 122 of the loadbreak leg 120 depicted in FIGS. 1-7, the central leg axis 122*a*, 122*b* for each of the one or more loadbreak legs 120*a*, 120*b* can diagonally extend in a variety of different angles relating to the central trunk axis 114. Moreover, according to certain embodiments, the central axis 122*a*, 122*b* of at least one of the plurality of loadbreak legs 120*a*, 120*b* can be non-parallel and non-perpendicular to the central trunk axis 114. For example, according to certain embodiments, each of the plurality of loadbreak legs 120*a*, 120*b* outwardly extend along a central leg axis 122*a*, 122*b* that is separated from the central trunk axis 114 by an angle (as indicated by "$\alpha_1$" or "$\alpha_2$" in FIG. 9) that is greater than 0 degrees and less than 90 degrees, and more preferably around 45 degrees. Additionally, according to certain embodiments, the angle ($\alpha_1$) separating the central leg axis 122*a* from the central trunk axis 114 for at least one of the loadbreak legs 120*a* can be different than the angle ($\alpha_2$) separating the central leg axis 122*b* of another loadbreak leg 120*b* from the central trunk axis 114.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A loadbreak bushing configured to be electrically coupled to a bushing well, the loadbreak bushing comprising:

a loadbreak trunk that extends along a central trunk axis from a first connection interface to a second connection interface of the loadbreak bushing, at least a portion of the first connection interface structured to be matingly received within the bushing well, the second connection interface outwardly extending to an opening at an end of the second connection interface that is positioned outside of an electrically conductive outer bushing jacket of the loadbreak bushing;

a loadbreak leg extending along a central leg axis from the loadbreak trunk to a third connection interface of the loadbreak bushing, the central leg axis being non-parallel and non-perpendicular to the central trunk axis;

an inner sleeve that extends into both the loadbreak trunk and the loadbreak leg, the inner sleeve having a first passageway that extends along the central trunk axis between an opening in the first connection interface and the opening in the second connection interface, the inner sleeve further comprising a second passageway that extends along the central leg axis in least a portion of the loadbreak leg, the second passageway being in fluid communication with an opening in the third connection interface; and a contact assembly housed within the second passageway of the inner sleeve, the contact assembly including a female contact;

wherein the central leg axis is angle relative to the central trunk axis.

2. The loadbreak bushing of claim 1, wherein each of the first, second, and third connection interfaces are male connection interfaces.

3. The loadbreak bushing of claim 1, wherein the loadbreak trunk and the loadbreak leg include an outer bushing jacket and an insulating jacket, at least a portion of the insulating jacket being housed within the outer bushing jacket, and further wherein the first, second, and third connection interfaces comprise at least a portion of the insulating jacket.

4. The loadbreak bushing of claim 3, wherein the inner sleeve is housed within the insulating jacket.

5. The loadbreak bushing of claim 4, wherein the first passageway of the inner sleeve is not in fluid communication with the second passageway of the inner sleeve.

6. The loadbreak bushing of claim 1, wherein the central leg axis is about 45 degrees from the central trunk axis.

7. The loadbreak bushing of claim 1, wherein the first passageway includes a first portion and a second portion, the first portion extending to around the opening in the first connection interface and has a first diameter, the second portion extending to around the opening in the second connection interface and has a second diameter, the second diameter being larger than the first diameter such that a shoulder is formed at an intersection of the first and second portions of the first passageway.

8. A loadbreak bushing configured to be coupled to a bushing well, the loadbreak bushing comprising:

an outer bushing jacket having a central jacket trunk and at least one jacket leg, the central jacket trunk extending between a first end and a second end of the central jacket trunk along a central trunk axis, each of the at least one jacket leg extending from the central jacket trunk along a central leg axis that is both non-parallel and non-perpendicular to the central trunk axis;

an insulating jacket, a portion of the insulating jacket extending along the central trunk axis between at least a first connection interface and a second connection interface of the insulating jacket, the first connection interface positioned outside of the first end of the central jacket trunk and configured to be matingly received within the bushing well, the second connection interface positioned outside of the second end of the central jacket trunk, and wherein, for each of the at least one jacket leg, the insulating jacket further includes an insulating leg that extends along the central leg axis and through an end of the at least one jacket leg, the portion of the insulating leg that extends through the end of the at least one jacket leg comprising at least another connection interface;

an inner sleeve housed within the insulating jacket, the inner sleeve being electrically conductive and including a first passageway that extends along the central trunk axis from the first connection interface to the second connection interfaces, the inner sleeve further including a second passageway in the insulating leg of each of the at least one jacket leg; and a contact assembly housed in the second passageway, the contact assembly including a female contact;

wherein the central leg axis is angle relative to the central trunk axis.

9. The loadbreak bushing of claim 8, wherein the central leg axis is about 45 degrees from the central trunk axis.

10. The loadbreak bushing of claim 8, wherein the at least one jacket leg comprises a first jacket leg and a second jacket leg, the first jacket leg and the second jacket leg being radially positioned about the central jacket trunk such that the central leg axis of the first jacket leg is separated from the central leg axis of the second jacket leg by around 90 degrees to around 270 degrees.

11. The loadbreak bushing of claim 10, wherein the first jacket leg extends from the central jacket trunk at a linear height between the first end and the second end of the central jacket trunk that is different than the linear height at which the second jacket leg extends from the central jacket trunk.

12. The loadbreak bushing of claim 8, wherein the at least one jacket leg comprises at least a first jacket leg, a second jacket leg, and a third jacket leg.

13. The loadbreak bushing of claim 12, wherein the second jacket let is positioned between the first jacket leg and the third jacket leg, the first jacket leg being radially separated from the second jacket leg by an angle that is different than an angle of radial separation between the second jacket leg and the third jacket leg.

14. The loadbreak bushing of claim 8, wherein the first passageway includes a first portion and a second portion, the first portion extending to around an opening in the first connection interface and has a first diameter, the second portion extending to around an opening in the second connection interface and has a second diameter, the second diameter being larger than the first diameter such that a shoulder is formed at an intersection of the first and second portions of the first passageway.

15. The loadbreak bushing of claim 14, wherein the first portion of the first passageway is shaped and sized to receive a bushing bolt that secures the loadbreak bushing to at least a well stud of the bushing well, and wherein the shoulder is positioned to be in abutting engagement with the bushing bolt when the bushing bolt is secured to the well stud.

16. A loadbreak bushing configured to be electrically coupled to a bushing well, the loadbreak bushing comprising:

a loadbreak trunk that extends along a central trunk axis from a first connection interface to a second connection interface of the loadbreak bushing, at least a portion of the first connection interface structured to be matingly received within the bushing well;

a plurality of loadbreak legs, each of the plurality of loadbreak legs extending along a central leg axis from the loadbreak trunk to a leg connection interface at an end of the loadbreak leg, the central leg axis for each of the plurality of loadbreak legs being non-parallel and non-perpendicular to both the central trunk axis and the central leg axis of other loadbreak legs of the plurality of loadbreak legs;

an inner sleeve housed in both the loadbreak trunk and the plurality of loadbreak legs, the inner sleeve being electrically conductive and having a first passageway that extends along the central trunk axis from an opening in the first connection interface to an opening in the second connection interface, the opening of the second connection interface being positioned outside of an electrically conductive outer bushing jacket of the loadbreak bushing, the inner sleeve further comprising, for each of the plurality of loadbreak legs, a second passageway that extends along the central leg axis in a portion of each of the loadbreak leg, the second passageway being in fluid communication with an opening in the leg connection interface; and a contact assembly housed within the second passageway of the inner sleeve, the contact assembly including a female contact and an arc quenching material;

wherein the central leg axis is angle relative to the central trunk axis.

17. The loadbreak bushing of claim 16, wherein the central leg axis for each of the plurality of loadbreak legs is about 45 degrees from the central trunk axis.

18. The loadbreak bushing of claim 16, wherein at least one of the plurality of loadbreak legs includes a first loadbreak leg, a second loadbreak leg, and a third loadbreak leg, the second loadbreak leg being position between the first and third loadbreak legs, and wherein the second loadbreak leg is radially separated from the first loadbreak leg by a first angle and is radially separated from the third loadbreak leg by a second angle, the first angle being different than the second angle.

19. The loadbreak bushing of claim 16, wherein each of the plurality of loadbreak legs is radially separated from an adjacent one of the plurality of loadbreak legs by an angle that is around 90 degrees to around 180 degrees.

20. The loadbreak bushing of claim 16, wherein at least one of the plurality of loadbreak legs extends at an axial height along the loadbreak trunk between the first and second connection interfaces that is different than the axial height at which another of the plurality of loadbreak legs extends from the loadbreak trunk.

* * * * *